US009986874B2

(12) United States Patent
Formon et al.

(10) Patent No.: US 9,986,874 B2
(45) Date of Patent: Jun. 5, 2018

(54) ABSORBENT SHEET DISPENSER HAVING IMPROVED HAND SENSOR PERFORMANCE

(75) Inventors: John S. Formon, Appleton, WI (US); Scott Wagner, Kimberly, WI (US)

(73) Assignee: SCA TISSUE NORTH AMERICAN LLC, Philadelphia, PA (US)

( * ) Notice: Subject to any disclaimer, the term of this patent is extended or adjusted under 35 U.S.C. 154(b) by 1079 days.

(21) Appl. No.: 12/624,842

(22) Filed: Nov. 24, 2009

(65) Prior Publication Data

US 2010/0133288 A1 Jun. 3, 2010

Related U.S. Application Data

(60) Provisional application No. 61/119,236, filed on Dec. 2, 2008.

(51) Int. Cl.
*B65H 3/00* (2006.01)
*A47K 10/34* (2006.01)

(52) U.S. Cl.
CPC ..... *A47K 10/34* (2013.01)

(58) Field of Classification Search
CPC ..... A47K 10/34
USPC ..... 221/258, 45; 361/220
See application file for complete search history.

(56) References Cited

U.S. PATENT DOCUMENTS 3,636,408 A * 1/1972 Shuman ..... H05F 3/02 225/6
4,786,005 A * 11/1988 Hoffman ..... A47K 10/3687 226/127
5,150,273 A * 9/1992 Le Vantine ..... H05F 3/02 361/212
5,179,497 A * 1/1993 Bakhoum ..... A61N 1/14 307/9.1
5,365,783 A * 11/1994 Zweifel ..... G01F 23/266 324/662
5,413,499 A * 5/1995 Wright et al. ..... 439/500
5,630,196 A 5/1997 Swain
5,730,165 A * 3/1998 Philipp ..... E03C 1/057 137/1
5,815,773 A * 9/1998 Zaman ..... G03G 15/751 399/117

(Continued)

FOREIGN PATENT DOCUMENTS

WO 02/09979 A 2/2002

OTHER PUBLICATIONS

International Search Report in Corresponding Application No. PCT/US2009/062331 dated Mar. 15, 2010.

*Primary Examiner* — Rakesh Kumar
(74) *Attorney, Agent, or Firm* — Drinker Biddle & Reath LLP

(57) ABSTRACT

A hands-free dispenser for dispensing lengths of absorbent sheet products, includes: a dispenser body containing a dispensing mechanism; a hand sensor for detecting the presence of a user's hand in the vicinity of the dispenser; an elongated metallic conductive element having a proximate end in electrical communication with at least one metal surface of the dispenser positioned at a first location relative to the hand sensor, and a distal end in electrical communication with at least one charge receiver positioned at a second location relative to the hand sensor, the second location being at a greater distance from the hand sensor than the first location.

19 Claims, 2 Drawing Sheets

(56) References Cited

U.S. PATENT DOCUMENTS 6,048,119 A * 4/2000 Kato ..... B65H 29/20 271/208
6,104,896 A * 8/2000 Zaman ..... G03G 15/751 29/407.08
6,117,575 A * 9/2000 Dinsdale ..... H01M 2/1055 429/1
6,118,469 A * 9/2000 Hosomi ..... B26D 1/305 347/222
6,241,537 B1 * 6/2001 Tate ..... H01R 13/6485 361/799
6,528,836 B2 * 3/2003 Lee ..... G03F 1/40 257/298
6,952,555 B2 * 10/2005 Oh ..... B65H 37/00 399/388
7,002,786 B2 * 2/2006 Signorino ..... B60R 16/06 361/216
7,050,736 B2 * 5/2006 Hale et al. ..... 399/90
7,089,918 B2 * 8/2006 Gilmour ..... B60K 15/00 123/509
7,140,247 B2 * 11/2006 Forgue ..... B01D 35/26 73/305
7,161,359 B2 * 1/2007 Denen ..... A47K 10/3687 324/662
7,845,593 B2 * 12/2010 Formon ..... A47K 10/36 242/560.1
7,846,279 B2 * 12/2010 Oh et al. ..... 156/72
7,878,446 B2 * 2/2011 Reinsel ..... A47K 10/36 242/564.4
8,186,551 B2 * 5/2012 Morris ..... A47K 10/36 225/10
2001/0046801 A1 * 11/2001 Tate ..... H01R 13/6485 439/181
2003/0013258 A1 * 1/2003 Lee ..... G03F 1/40 438/298
2005/0072874 A1 * 4/2005 Denen ..... A47K 10/3687 242/563
2007/0023486 A1 2/2007 Matsuura et al.
2007/0029435 A1 * 2/2007 Moody ..... A47K 10/3687 242/559.2
2008/0011772 A1 * 1/2008 Morris ..... A47K 10/36 221/258
2008/0100982 A1 * 5/2008 Lewis ..... A47K 10/3687 361/220
2010/0089939 A1 * 4/2010 Morris ..... A47K 10/36 221/1
2010/0133288 A1 * 6/2010 Formon ..... A47K 10/34 221/45
2012/0097699 A1 * 4/2012 Formon ..... A47K 10/36 221/199

* cited by examiner

ABSORBENT SHEET DISPENSER HAVING IMPROVED HAND SENSOR PERFORMANCE

FIELD OF THE INVENTION

This invention relates to hands-free dispensers for absorbent sheet products (preferably paper towels), and provides dispensers having improved hand sensor performance in hands-free mode.

BACKGROUND OF THE INVENTION

The present inventors have recognized that the presence of metal objects or surfaces in hands-free dispensers, in the vicinity of the hand sensor, sometimes adversely affects the hand sensor performance. United States Published Patent Application No. 2007/0234868, the entirety of which is hereby expressly incorporated by reference herein, describes a hands-free dispenser in which a capacitive hand (proximity) sensor projects through an opening in the front cover of the dispenser, which permits the dispenser cover to have a metallic outer surface.

When developing dispensers as described in United States Published Patent Application No. 2007/0234868, it has been found that when the cover has a nickel-plated outer surface, the performance of the capacitive hand sensor can be adversely affected, resulting, for example, in decreased sensitivity of the hand sensor, hypersensitivity of the hand sensor, and/or spontaneous shutting down of the hand sensor. Additional problems can arise due to accumulation of static electricity on the metallic dispenser parts and/or surfaces, which can result in problems such as double feeding of the absorbent sheet through the internal rollers of the dispenser, spontaneous shutting down of the hand sensor, and uncontrolled dispensing of paper.

SUMMARY OF THE INVENTION

The present inventors have discovered that one or more of these problems can be mitigated by providing a conductive path from one or more of the metal surfaces that interferes with the intended operation of the dispenser, to a charge receiver that is positioned more remote from the hand sensor than the interfering metal surfaces.

The invention is preferably applied to hands-free dispensers utilizing capacitive proximity sensors for hand detection, as described for example in United States Published Patent Application No. 2007/0234868, but may also be applied to dispensers utilizing hand sensors that operate on different detection principles, such as active or passive infrared hand sensors.

The invention preferably draws charge away from a metallized front cover and/or a metal dispensing roller mounted within the dispenser housing, but it will be appreciated that the invention may draw charge away from any metal surface or component of the dispenser, or away from any metal article proximate the dispenser, that interferes with the intended manner of dispenser operation.

In a preferred embodiment, a conductive wire is mounted inside the dispenser housing, and is electrically connected at one end to both a metallized dispenser cover and a rotating aluminum pinch roll mounted within the dispenser. The wire is preferably encased in plastic or other insulating material intermediate its exposed ends. The wire is preferably connected at its other exposed end to a negative terminal of the battery compartment that holds the batteries powering the dispenser. This embodiment provides a self-contained conductive path that does not complicate the installation of the dispenser; and although the wire does not serve to ground the metal surfaces to any object outside the dispenser, it nevertheless provides improved hand sensor performance by providing a conductive path between the interfering metal surfaces and the more rearwardly-positioned battery compartment.

When the conductive element is connected at its proximate end to a moving member such as an aluminum pinch roll, the electrical contact will be established by suitable means such as a metallic brush element. When the conductive element is connected at its proximate end to the dispenser cover, it is preferred that the electrical contact occur through the intermediary of a conductive element such as a metallic spring that is mounted on the dispenser body, and which is in electrical contact with the dispenser cover only when the cover is closed.

It will be appreciated that the interfering metal surfaces and components will typically not be connected to the charge receiver other than by the conductive element according to the invention. For example, a wire supplying driving current to an electric motor would not be a conductive element according to the invention, because such a wire is attendant to the normal operation of the motor. The interfering metal surfaces according to the invention are therefore those that are not necessarily connected to the charge receiver, be it the battery compartment or another charge receiver, for their conventional operation.

It will be appreciated that the conductive path can take forms other than that of a wire, for example, a metallic element mounted to an interior surface of the dispenser body. Such a metallic element, whether in the form of a wire or flexible plate, may be encased in insulating material intermediate the connections to the interfering surfaces and the charge receiver, or may be exposed in these intermediate regions. In another embodiment, interior brackets are formed in the dispenser body at the time of injection molding of the same, and the conductive element is positioned in these brackets. The brackets may hold a conductive element that has already been provided with an insulating covering, or the brackets may themselves provide an insulating covering that partially or completely covers an otherwise exposed conductive element.

As noted above, the charge receiver is the negative terminal of the battery compartment in one embodiment of the invention, which utilizes the batteries as a charge sink when the dispenser is in operation. However, the charge receiver may take the form of other metallic elements either inside or outside the dispenser housing, provided that such charge receiver is positioned at a greater distance from the hand sensor than the interfering metallic surfaces to which the conductive element is connected at its other end. It is nevertheless preferred that the charge receiver be a metallic component inside the dispenser housing, in light of the benefits described above.

The invention is applicable not only to battery-powered dispensers but also to hard-wired dispensers that draw their current supply from the mains of the facility in which they are installed. In that case, the distal end of the conductive element would be connected to a suitable charge receiver inside or outside of the dispenser.

DETAILED DESCRIPTION OF AN EMBODIMENT

Figure 1:
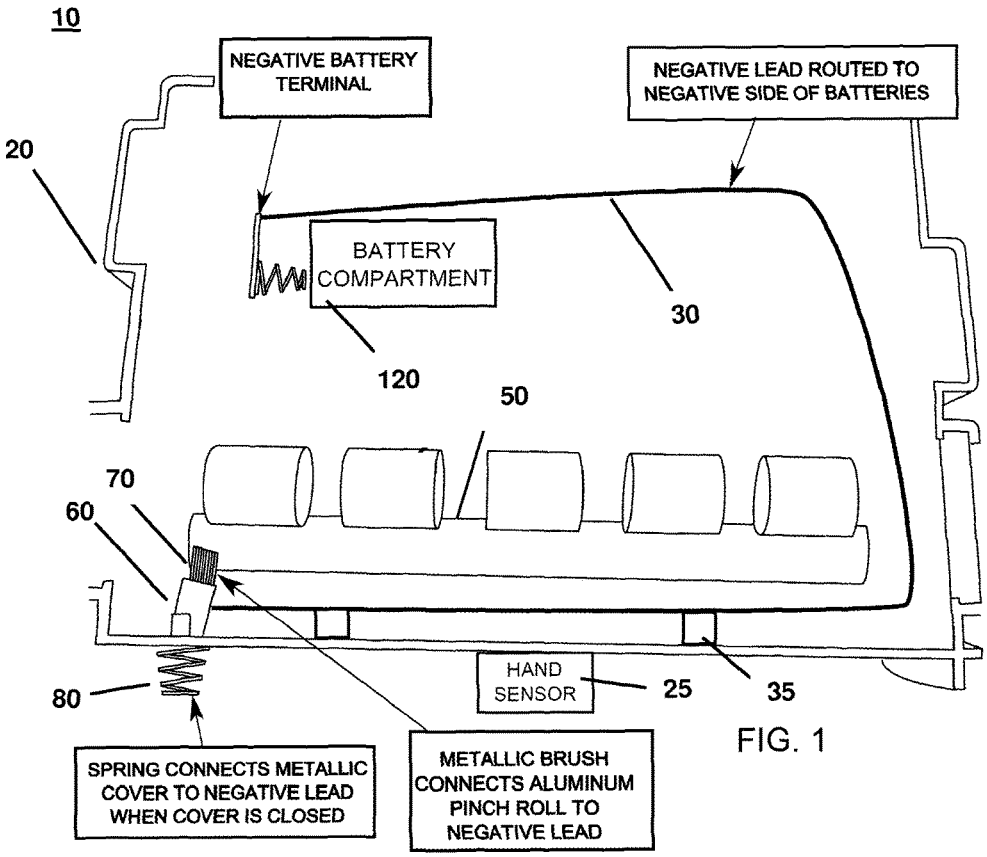
FIG. 1 shows a front view of an embodiment of the present invention.
Figure 2:
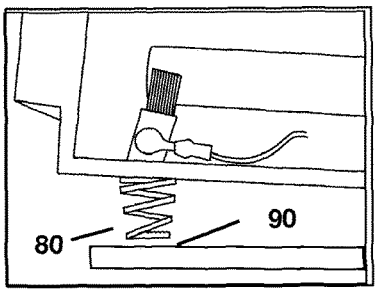
FIG. 2 shows a proximate end connection of a wire of the embodiment of FIG. 1 in greater magnification.
Figure 3:
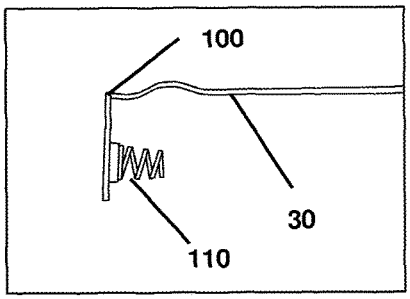
FIG. 3 shows a distal end connection of the wire of the embodiment of FIG. 1 in greater detail.
Figure 4:
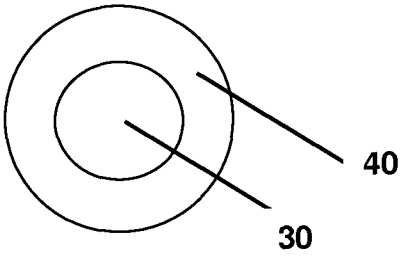
FIG. 4 shows a cross sectional view of the wire.
Figure 5:
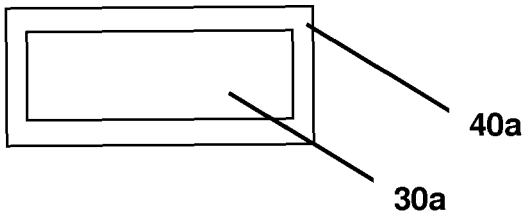
FIG. 5 shows a cross sectional view of a flexible plate or leaf.

The accompanying figures illustrate a preferred embodiment of the invention. In FIG. 1, a cassette 20 of a hands-free dispenser 10 having a hand sensor 25 is shown, that incorporates the one version of the improvement of the present invention. That cassette 20 corresponds to the cassette shown in the figures of United States Published Patent Application No. 2007/0234868. As shown in FIG. 1 and FIG. 3, a conductive wire 30 encased in red plastic 40 is connected at one end to both an aluminum pinch roll 50 (corresponding to the roll 16 shown in FIG. 5 of United States Published Patent Application No. 2007/0234868) via a metallic bracket 60 and a metallic brush 70, and (via the same metallic bracket) to a metallic spring 80 that is in electrical contact with the dispenser cover 90 when this latter is closed. The wire 30 can be mounted on the cassette 20 via brackets 35. Instead of a wire, a metallic plate or leaf 30*a* can be used within insulation 40*a*, as is shown in FIG. 5. The particulars of this proximate end connection are shown at greater magnification in FIG. 2. At its distal end 100, the wire 30 is connected to the negative terminal 110 of the battery compartment 120, and hence to the negative side of the batteries when the dispenser is in use, as shown in greater detail in FIG. 3.

The following claims reflect various aspects of the inventors' current contemplation of the present invention, and are presented without prejudice to the possible claiming of the invention differently and/or more broadly in a subsequent PCT application or application filed under 35 USC § 111(a), and these claims should not impair the ability of any such subsequent application to claim the priority of the present application under 35 USC § 119(e) or any other applicable statute or rule.

What is claimed is:

1. A hands-free dispenser for dispensing lengths of absorbent sheet products, said dispenser comprising:

a dispenser housing containing walls enclosing a dispensing mechanism and a battery compartment housing a battery that drives the dispensing mechanism;

a hand sensor for detecting the presence of a user's hand in the vicinity of the dispenser;

a single elongated metallic conductive element fully contained within said walls of the dispenser housing having a proximate end in direct conductive electrical communication with at least one metal surface of said dispenser positioned at a first location relative to said hand sensor, and a distal end in direct conductive electrical communication only with a negative terminal of the battery compartment positioned at a second location relative to said hand sensor, the second location being at a greater distance from the hand sensor than the first location, the first and second locations both being fully contained within said walls of the dispenser housing, wherein the battery is a charge receiver that draws charge away from the at least one metal surface to the negative terminal of the battery compartment through direct conductive electrical communication with the elongated metallic conductive element.

2. The dispenser as claimed in claim 1, wherein the elongated metallic conductive element is a wire.

3. The dispenser as claimed in claim 2, wherein the wire is encased in insulating material intermediate proximate and distal ends of the wire.

4. The dispenser as claimed in claim 1, wherein only one terminal of the battery compartment is in electrical communication with the at least one metal surface of said dispenser.

5. The dispenser as claimed in claim 1, wherein a proximate end of the elongated metallic conductive element is in electrical communication with at least one of a metallized dispenser cover or a metallic pinch roller.

6. The dispenser as claimed in claim 1, wherein the elongated metallic conductive element is in electrical communication at a proximate end of the conductive element with a metallic pinch roller via a metallic brush.

7. The dispenser as claimed in claim 1, wherein the elongated metallic conductive element is in electrical communication at a proximate end of the conductive element with a metallized dispenser cover via a metallic spring mounted on the dispenser housing.

8. The dispenser as claimed in claim 1, wherein the wire is in direct electrical communication at a proximate end of the conductive element with a metallized dispenser cover via a metallic spring mounted on the dispenser housing.

9. The dispenser as claimed in claim 1, wherein the elongated metallic conductive element is a flexible metallic plate or leaf.

10. The dispenser as claimed in claim 9, wherein the elongated metallic conductive element is mounted via at least one bracket that is connected to at least one interior surface of said dispenser housing.

11. A hands-free dispenser for dispensing lengths of absorbent sheet products, said dispenser comprising:

a dispenser housing containing walls enclosing a dispensing mechanism and a battery compartment housing a battery that drives the dispensing mechanism;

a hand sensor for detecting the presence of a user's hand in the vicinity of the dispenser;

a single insulated wire fully contained within said walls of the dispenser housing having an uninsulated proximate end in direct conductive electrical communication with at least one metal surface of said dispenser positioned at a first location relative to said hand sensor, and an uninsulated distal end in direct conductive electrical communication only with a negative battery terminal of the battery compartment positioned at a second location relative to said hand sensor, the second location being at a greater distance from the hand sensor than the first location, the first and second locations both being fully contained within said walls of the dispenser housing, wherein the battery is a charge receiver that draws charge away from the at least one metal surface to the negative terminal of the internally exposed battery compartment through direct conductive electrical communication with the elongated metallic conductive element.

12. The dispenser as claimed in claim 11, wherein the wire is in direct electrical communication at a proximate end of the wire with a metallic pinch roller via a metallic brush.

13. The dispenser as claimed in claim 11, wherein the wire has a proximate in direct electrical communication with at least one of a metallized dispenser cover or a metallic pinch roller.

14. A hands-free dispenser for dispensing lengths of absorbent sheet products, said dispenser comprising:

a dispenser housing containing walls enclosing a dispensing mechanism and a battery compartment housing a battery that drives the dispensing mechanism;

a hand sensor for detecting the presence of a user's hand in the vicinity of the dispenser;

a single insulated flexible metallic plate or leaf fully contained within said walls of the dispenser housing having an uninsulated proximate end in direct conductive electrical communication with at least one metal surface of said dispenser positioned at a first location relative to said hand sensor, and an uninsulated distal end in direct conductive electrical communication only with a negative battery terminal of the battery compartment positioned at a second location relative to said hand sensor, the second location being at a greater distance from the hand sensor than the first location, the first and second locations both being fully contained within said walls of the dispenser housing, wherein the battery is a charge receiver that draws charge away from the at least one metal surface to the negative terminal of the battery compartment through direct conductive electrical communication with the elongated metallic conductive element.

15. The dispenser as claimed in claim 14, wherein the flexible metallic plate or leaf has a proximate in direct electrical communication with at least one of a metallized dispenser cover or a metallic pinch roller.

16. The dispenser as claimed in claim 14, wherein the flexible metallic plate or leaf is in direct electrical communication at a proximate end of the wire with a metallic pinch roller via a metallic brush.

17. The dispenser as claimed in claim 14, wherein the flexible metallic plate or leaf is in direct electrical communication at a proximate end of the conductive element with a metallized dispenser cover via a metallic spring mounted on the dispenser housing.

18. The dispenser as claimed in claim 11, wherein only one terminal of the battery compartment is in electrical communication with the at least one metal surface of said dispenser.

19. The dispenser as claimed in claim 14, wherein only one terminal of the battery compartment is in electrical communication with the at least one metal surface of said dispenser.

* * * * *